US006802907B2

(12) United States Patent
Lewis, III et al.

(10) Patent No.: US 6,802,907 B2
(45) Date of Patent: Oct. 12, 2004

(54) REMOVING RADAR ABSORBING COATINGS

(75) Inventors: David Lewis, III, Alexandria, VA (US); Arne W. Fliflet, Alexandria, VA (US); Ralph W. Bruce, Arnold, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 161 days.

(21) Appl. No.: 10/320,699

(22) Filed: Dec. 16, 2002

(65) Prior Publication Data

US 2004/0112403 A1 Jun. 17, 2004

(51) Int. Cl.[7] ..... B08B 3/10
(52) U.S. Cl. ..... 134/1; 427/553; 427/595
(58) Field of Search ..... 134/1, 42; 427/553, 427/595

(56) References Cited

U.S. PATENT DOCUMENTS 5,782,253 A * 7/1998 Cates et al. ..... 134/105
6,051,283 A * 4/2000 Lee et al. ..... 427/553
6,347,976 B1 * 2/2002 Lawton et al. ..... 451/6

* cited by examiner

*Primary Examiner*—Frankie L. Stinson
*Assistant Examiner*—Saeed Chaudhry
(74) *Attorney, Agent, or Firm*—John J. Karasek; George A. Kap

(57) ABSTRACT

Process for removing microwave energy absorbing material disposed on a substrate without thermally and/or mechanically damaging the substrate and with reduced production of volatile matter comprising the steps of directing microwave energy at the coating of sufficient power to damage the coating and removing the damaged coating from the substrate.

20 Claims, 2 Drawing Sheets

REMOVING RADAR ABSORBING COATINGS

FIELD OF THE INVENTION

This invention pertains to removal of radar absorbing coatings, and other coatings that absorb microwave energy, from a substrate using microwave energy.

DESCRIPTION OF RELATED ART

The processes that have been used to remove radar absorbing material coatings from substrates, particularly from aircraft and ships, include mechanical abrasion; grit blasting, including using dry ice as the abrasive; mechanical scraping; heat lamps; and continuous and pulsed lasers. Conventional mechanical abrasion using conventional abrasives and wire brushes are rather ineffective in removing some of the coatings which are based on rubbery polymers, such as urethanes used for all-around purposes, neoprenes used for their weather resistance, nitrile rubbers used for their fuel and oil resistance, and fluoro-elastomers used for their excellent operating temperature range. In addition, this method produces substantial volume of waste products, including mixtures of abrasives and coating residue, requiring special disposal. Grit blasting, which has been done with conventional abrasives, plastic abrasives and, most recently with crushed dry ice as the abrasive, is not very effective against the rubbery coatings, suffers from problems with waste and with the use of dry ice which results in evolution of substantial amounts of carbon dioxide emissions as well. Mechanical scraping can be done successfully but it is very labor-intensive, requires skilled workers, and carries with it risks of significant damage to the substrate to which the coating is or was bonded.

The rest of the methods are either thermal or thermomechanical in nature. Heat lamps are limited in maximum power density deposited in the coatings and heat the coating from the outward surface inward, depending on heat conduction through the low conductivity coating to degrade the bulk of the coating. As a result, significant time is involved in raising the entire coating thickness to a temperature that would degrade it, and the substrate is consequently heated as well. Such techniques also result in large emissions of volatile organic compounds as the outer layer of the coating is heated to very high temperature. The use of continuous lasers, such as the carbon dioxide lasers, has the advantage of permitting higher power density than with heat lamps but has most of the same disadvantages as well. Pulsed lasers, especially very short pulse systems, can be used to remove material by ablation where the local power density is so high that the material within the beam is vaporized or spalled off by vapor generation. However, this is still a surface process and the laser radiation penetrates only a very short distance, of approximately 1 micron, into the coating resulting in a relatively slow material removal process, that has to work its way down through the coating thickness and is limited by the ablation products blocking the incident radiation, rather then removing it completely in one operation.

As the name implies, radar absorbing materials or microwave absorbers are coatings whose electrical and magnetic properties have been altered to allow absorption of microwave energy at discrete or broadband frequencies. These materials are typically produced by using existing materials and altering their dielectric and magnetic properties. For purposes of analyses, the dielectric properties of a material are categorized as its permittivity and the magnetic properties as its permeability. Both terms are characterized as complex numbers with real and imaginary parts. Common dielectric materials used for absorbers, such as foams, honeycombs, netting, plastics and elastomers, have no magnetic properties, giving them permeabilities of 1. Magnetic materials, such as ferrites, iron and cobalt-nickel alloys, are used to alter the permeabilities of the materials. High conductivity materials, such as carbon, graphite and metal flakes, are used to modify the dielectric properties.

The increased need for radar absorbing materials has resulted from two ongoing developments: the first being the greater number of electronics systems being incorporated into vehicles, including aircraft and ships, which has resulted in a corresponding growth in electromagnetic interference. These problems include false images, increased clutter on radars and reduced performance because of system-to-system coupling. The second development being that there are ever greater requirements for reduced radar cross section of weapon systems. Not only is there a need to reduce a vehicle's signature, but equally as important is the need to reduce the signature of various electronic warfare systems and payloads attached to these vehicles. Radar absorbing materials play a key role in stealth technology and their use is a major factor in radar cross section reduction.

OBJECTS AND BRIEF SUMMARY OF THE INVENTION

It is an object of this invention to remove radar absorbing materials and other materials from substrates, such as aircraft and ships, by the use of microwave energy.

It is another object of this invention to minimize production of volatile compounds and other hazardous waste and byproducts resulting from removal of coatings from metallic and non-metallic substrates.

Another object of this invention is to minimize or eliminate thermal and mechanical damage to substrates to which coatings are secured.

Another object of this invention is to remove a coating from a substrate quickly by the use of microwave energy.

These and other objects of this invention can be achieved by directing microwave energy at a coating disposed on a substrate to degrade the coating and then removing the coating from the substrate.

BRIEF DESCRIPTION OF THE DRAWINGS

For a better understanding of these and other objects of the present invention, reference herein is made to the following detailed description of the invention which is to be read in conjunction with the accompanying drawings wherein.

DETAILED DESCRIPTION OF THE INVENTION

Figure 1:
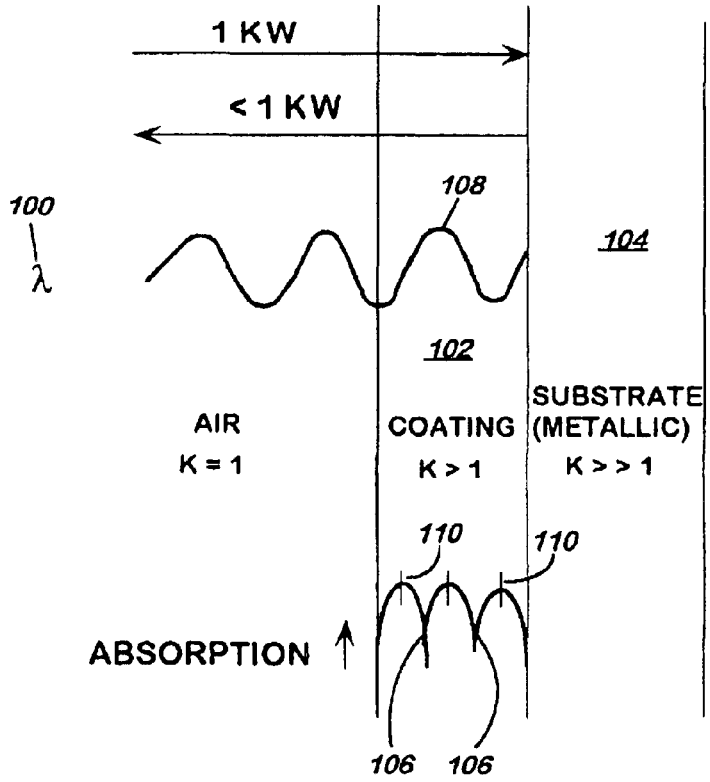
FIG. 1 is a graphical illustration of a wave propagating through air and the coating having a dielectric constant $\in$.

This invention is directed to a process for quickly removing a coating, particularly a radar absorbing coating, adhering to a substrate by the use of microwave energy, the process intending to minimize or eliminate thermal and mechanical damage to substrates and to minimize production of volatile compounds and other hazardous waste and byproducts.

The process of this invention can be conducted in a stationary mode with the microwave energy beam illuminating the entire area of a coated article of simple geometry but small enough to be heated by the power available in the system. In an alternate embodiment, which is preferred for large articles or articles of complex shape, either the beam is rastered over the surface of the article using reflective optics for control of the beam location and size, or the article is manipulated under a stationary beam using a multiaxial system for translating and rotating the article. The speed at which the beam is rastered or the article is moved is controlled by the requirements for sufficient energy deposition. The high frequency used here permits manipulation of the beam using reflective metal optics of reasonable size mirrors on the order of 15–20 cm in diameter. Control of the process is possible using optical infrared thermometry to measure the surface temperature of the coating, coupled with modeling results and experimental measurements that correlate this temperature with the rise in internal temperature in the coating.

In a preferred embodiment, a millimeter-wave beam source of microwave energy of high frequency is used to rapidly heat a metal or ceramic-filled radar absorbing polymeric coating bonded to a substrate. If the coating is of high dielectric constant and has high dielectric loss and there is an electrically conducting reflective layer between the coating and the composite layer, the millimeter-wave beam source will deposit significant amounts of energy in the coating with the peak in the energy typically occurring within the thickness of the coating. For sufficient amounts of energy deposition, i.e., sufficient power density in the beam, the interior of the coating is rapidly heated to a temperature of perhaps 200–400° C., which degrades the polymeric constituents of the coating, producing volatiles and gases within the bulk of the coating and causes the coating to debond and separate from the substrate. During this process, very little heat is transferred to the substrate, resulting in minimal heating of the substrate and no thermal damage to the substrate. Following this process, the debonded and degraded coating can be physically removed from the substrate with no damage to the substrate surface.

The microwave band is defined in terms of energy as being from about $5\times10^{-23}$ to $5\times10^{-21}$ joules and in terms of wavelength ($\lambda$) as being from 1 to 100 millimeters. Suitable beam density is 50–500 W/cm$^2$ and suitable energy density is 100–1000 J/cm$^2$. Suitable frequency of the microwave energy is from 900 MHz to 120 G Hz, particularly 25–100 GHz, with microwave energy of 80–100 G Hz generally used to remove radar absorbing coatings from aircraft where coating thickness is typically on the order of mm and microwave energy of 25–35 G Hz is generally used to remove radar absorbing coatings from ships where coating thickness is on the order of cm. Source of the microwave energy is typically a gyrotron and since the millimeter-wave region range is approximately 30–300 GHz, the millimeter-wave energy region includes the energy band suitable herein.

The microwave band is one of many energy bands which include absorbing radio, absorbing infrared, absorbing visible, absorbing ultraviolet, penetrating x-rays, penetrating gamma rays and penetrating cosmic rays. The wavelengths of these bands rage from the longest radio waves of up to about 100 meters to the shortest cosmic rays of down to about 1 picometer. On the energy side, which is inversely proportional to the wavelength, the energy varies from the lowest for radio waves of about $5\times10^{-26}$ joules to the highest for cosmic rays of about $10^{-12}$ joules. Although some of these energy bands are absorbed in coating materials, they are absorbing to an extent that is either too great or insufficient for the purpose of this invention except for the microwave energy band which is suitable for purposes herein. The energy bands that are absorbed very little and penetrate very well, however, are clearly unsuitable for purposes herein since they deposit insufficient energy within the coating and thus do not heat and either debond or break-down the coating to where its removal from a substrate to which it adheres is facilitated. Also, the energy bands used for radar have to be coordinated with attenuation due to gaseous constituents and precipitation for transmission through the atmosphere since radar absorbing material is designed to be receptive to radiation passing through the atmospheric transmission windows such as the L band, which is transmissive at about 900 MHz, the S band, which is transmissive at about 2.5 GHz, the X band, which is transmissive at about 30 GHz and the W, band which is transmissive at about 94 GHz.

As already noted, radar absorbing materials are coatings whose electrical and magnetic properties have been altered to allow absorption of microwave energy, particularly microwave energy of frequency of from 900 MHz to 94 GHz, at discrete or broadband frequencies. As used herein, broadband frequencies are frequencies within a range of about ±20% of some nominal value, e.g., 2–3 GHz for the S band. The coating material suitable herein must be either a polymer that absorbs microwave energy or a material filled with fillers that are introduced into a polymer that render the material absorptive of microwave energy. Typical fillers are particulate metallic and/or ceramic materials. An example of a polymer that readily absorbs microwave energy is polyvinyl chloride and an example of one that does not is polyethylene.

Explanation of the process for removing radar absorbing coating from a substrate to which the coating adheres, can be facilitated by reference to FIG. 1 where a wave 100 of wavelength $\lambda$ is shown propagating through air, where dielectric constant is 1, and then into radar absorbing coating 102, where dielectric constant K is greater than 1, which coating is adjacent to and adheres to metallic substrate 104, where dielectric constant is much greater than 1. The wave 100 propagating through air has wavelength $\lambda$ which is reduced considerably when it enters the coating. So, assuming a frequency of 83 G Hz of the microwave energy, its wavelength through air is 3.6 mm, which is derived by dividing the speed of light of $3\times10^8$ m/sec by the frequency of $83\times10^9$/sec. When this wave 100 of wavelength 3.6 mm in air enters coating 102, which has an assumed dielectric constant of k=50, its wavelength through the coating is reduced to about a seventh thereof, since wavelength through the coating is obtained by dividing wavelength through air by the square root of the dielectric constant of the coating, i.e., $3.6/\sqrt{50}$, or about 0.5 mm.

Bottom of FIG. 1 also graphically illustrates heating of the coating 102 by the wave 100. Since energy absorption is a square of the electric field of the wave, absorption is generally represented at bottom of FIG. 1 as curves 106 which correspond to the sinusoidal wave 108 within the coating, shown directly above. Squaring the corresponding quantities for the wave 108 within the coating yields curves 106, crests 110 of which indicate hot spots corresponding to crests 110 within coating 102 created by the traveling wave 100 of wavelength λ. If a number of hot spots corresponding to crests 110 are created within the coating, as by relative rastering of the coating and the energy source, then the coating will disintegrate or be damaged, assuming that the hot spots are sufficiently high in temperature. It is quite apparent that the more hot spots are located within the coating, the greater are the prospects for destroying the character of the coating to a point that it cracks and/or delaminates and can be easily removed from a substrate. However, it may be desirable to debond or delaminate the coating from the substrate so that it could be stripped from the substrate in which case, a different approach is taken. This approach is consistant with a typical application process where the coating is in the form of a continuous film of sufficient thickness which is adhered to a substrate by means of a suitable adhesive. In order to scrape or delaminate such a coating from a substrate more effectively, the system can be designed where wavelength λ of incoming energy is selected which would place a hot spot or crest 110 within the coating adjacent to the interface between coating 102 and substrate 104. Depending on many parameters, the spot size is typically on the order of 0.01–0.1 mm in thickness and up to about 5 cm in longitudinal extent extending generally parallel to the interface. Such a condition, i.e., where the hot spot is located in the vicinity of the interface, requires consideration of not only wavelength of the incoming microwave energy and thickness and mass of the coating, but also of many other parameters. The object of designing such a system is, of course, to introduce sufficient energy in the vicinity of the coating/substrate interface to heat the adhesive to an elevated temperature to facilitate removal of the coating from the substrate. This is particularly useful in instances where the substrate contour is not flat but curvaceous or where the coated substrate is in a difficult to reach location. The idea of heating an adhesive in order to weaken it so that removal of a coating secured by the adhesive to a substrate can be facilitated, is well known, however, here, removal of coating is facilitated without heating and possibly degrading the coating itself.

Figure 2:
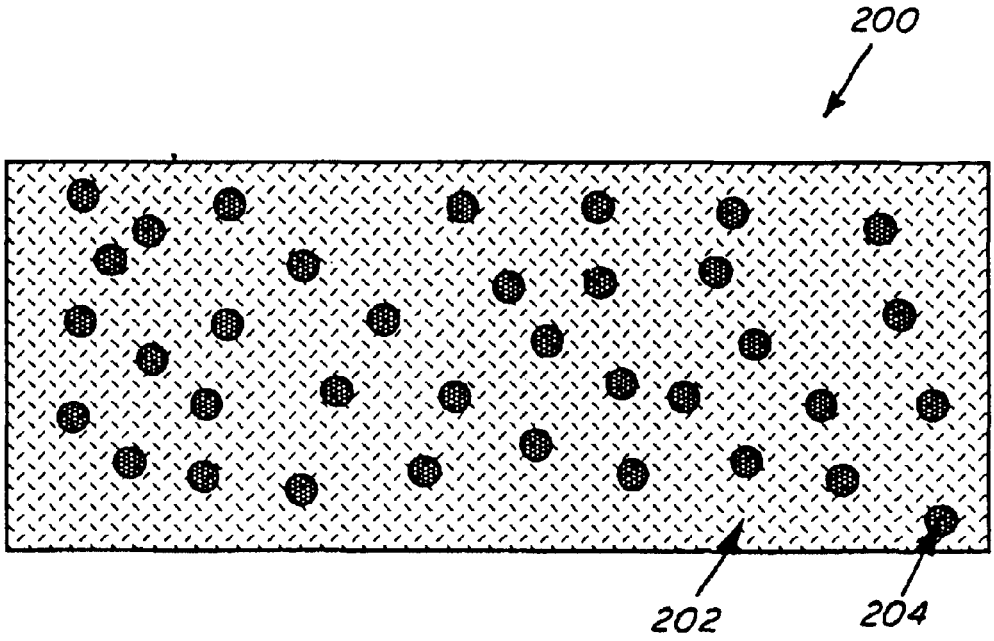
FIG. 2 is a cross-sectional view of a radar absorbing coating material composed of a matrix, particularly an elastomer, and particles, particularly electrically conducting materials, distributed throughout the matrix.

FIG. 2 illustrates a typical radar absorbing material 200 composed of matrix 202 and filler particles 204 dispersed in the matrix. Amount of the filler particles within the matrix is typically less than 10% by volume. The particles are typically 0.1 to 10 microns in diameter. Typically, the matrix is a fiber reinforced polymer and the filler particles are metallic or ceramic. If the matrix is secured to a metallic substrate, no other layer is typically employed, however, if the matrix is a fiber reinforced polymer, such as a polyurethane rubber or another suitable elastomer, then a thin metallic layer is interposed between the matrix and the substrate to facilitate absorption of radar energy and to function as lightning protection. If the coating material, i.e., the matrix and the fillers, absorb radar energy very strongly, however, it may be possible to dispense with the metallic layer at the interface, but such a coating is not presently available. This possibility exists particularly for very thick coatings that might be used on ships. Thickness of radar absorbing coatings, illustrated in FIG. 2, are on the order of millimeters for aircraft and on the order of centimeters and fractions of a centimeter for ships. Thickness of the coatings can vary widely, depending on application.

Figure 3:
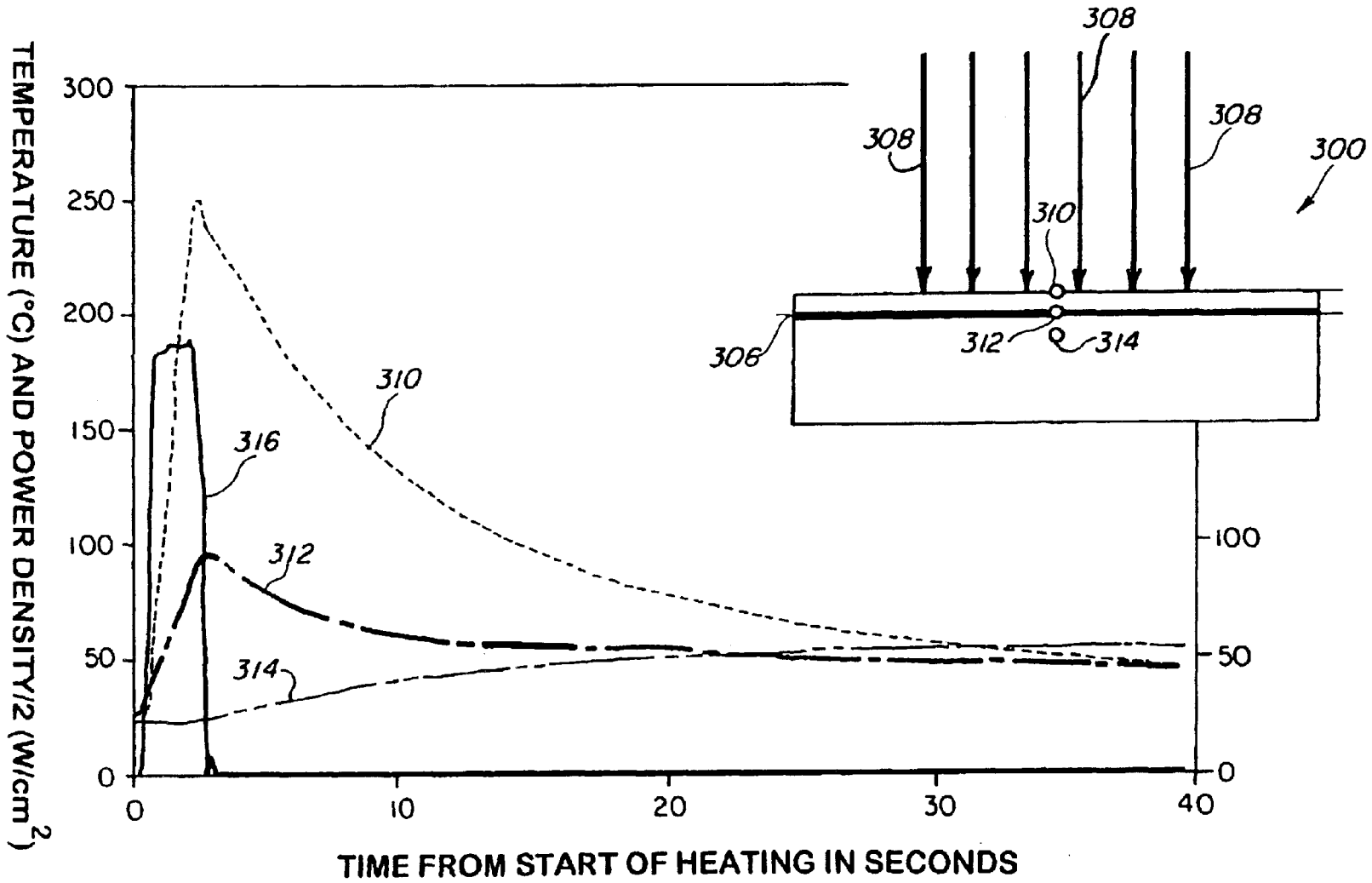
FIG. 3 is a plot of temperature and time from start of the microwave heating, as sensed by thermocouples disposed at different locations on and within a radar absorbing material and the substrate on which the material is disposed before its removal.

FIG. 3 illustrates a system 300 composed of exemplary radar absorbing coating 302 1 mm in thickness disposed on fiber reinforced polyester layer 304 5 mm in thickness and with aluminum foil 306 about 12 microns thick. The reinforced polyester layer and the aluminum foil form the substrate. Microwave energy from a gyrotron at frequency of 83 G Hz with 3.6 mm wavelength in air at power of 350 W/cm$^2$, shown by arrows 308, was trained at coating 302 for nearly 3 seconds, was applied at a distance of 100 cm yielding a spot size of about 5 cm. The coating, the aluminum foil and the fiber reinforced polyester layer were one on top of the other, as shown in FIG. 3, and these components were coextensive, measuring 10×10 cm. Thermocouple 310 was centrally disposed on top of coating 302 and measured temperature at that point, as did thermocouple 312, which was centrally disposed between coating and aluminum foil 306, and thermocouple 314, which was disposed centrally 3 mm below the top surface of the aluminum foil 306.

FIG. 3 is also a plot of temperature versus time at locations denoted by the thermocouples with plot 316 denoting power density of the power source, which was kept on for approximately 2 seconds and then turned-off, plot 310 corresponding to temperature variation with time of the front surface of the coating, plot 312 corresponding to temperature variation as measured by thermocouple 312, and plot 314 which corresponds to temperature variation as measured by thermocouple 314. The scale on y-axis of FIG. 3 is Temperature in ° C. and Power Density in W/cm$^2$, the scale being the same for both parameters. FIG. 3 shows that power, shown by plot 316, was turned on and reached about 190 W/cm$^2$ in less than 3 seconds and then it was turned off. The temperature, as read by thermocouples 310, 312 and 314 and recorded and illustrated by plots 310, 312 and 314, first rose and then declined. The top coating surface temperature rose to about to about 250° C. in the initial couple of seconds and then gradually declined to 50° C. over a period of 40 seconds. Temperature recorded by thermocouple 312, which was disposed between the coating and the aluminum foil, and illustrated by plot 312, reached only about 95° C. during the initial couple of seconds and then gradually declined to 50° C. over the period of 40 seconds after the power was turned off. Temperature recorded by thermocouple 314, which was disposed within the substrate, and illustrated by plot 314, remained generally constant over the initial period of couple of seconds, and then gradually increased to about 50° C. over the period of 40 seconds.

There is at least one unexpected result experienced by system 300 shown in FIG. 3 by momentary application of the microwave energy. As shown in FIG. 3, although temperature of the top surface reached 250° C., this level was not even approached anywhere within the substrate or even at the interface between the coating and the substrate. Temperature within the coating must have been above about 250° C. since the urethane coating decomposes at a temperature above 250° C. and it was found that the coating was decomposed. Therefore, although temperature within the coating exceeded 250° C. and apparently reached 400° C. or 500° C., temperature level at the interface between the coating and the aluminum foil reached only about 100° C. and temperature within the substrate reached only about 50° C. and never exceeded 50° C. Therefore, the temperature profile of the system is such that integrity of the substrate was not jeopardized during the microwave heating cycle since the highest temperature to which it was exposed is only a fraction of the internal temperature of the coating, which is substantially below degradation temperature of a fiber reinforced polymer.

The relatively low temperature below the coating can also be ascribed to the insulating property of the coating and the high thermal conductivity of the metallic layer (aluminum) disposed between the coating and the fiber reinforced polyester layer. However, the selectivity of the microwave heating is apparent to deposit energy within the coating so that only the coating is thermally degraded by scission, or otherwise, of the polymer bonds within the coating or selective heating of the adhesive securing the coating to the substrate so that removal of the coating from a substrate is facilitated.

This process enjoys the advantage of the capability to minimize production of volatile matter and other hazardous waste and byproducts. When heating a coating material that contains volatile components, evolution of such components cannot effectively be eliminated but evolution thereof can be minimized and made tolerable to the operation. If the coating matrix is polyurethane, it is relatively impermeable to volatile compounds and it is hypothesized that the volatile components generated during heating and decomposition of the coating matrix form as of a sac encased in a polymer. The sac enlarges as the ambient temperature increases and there is a risk that the sac will rupture and release its contents of volatile compounds to the surroundings. Within the coating, many such sacs are formed during heating of the coating materials and some of them may rupture but most of them do not and as the energy is turned off and the system begins to cool, volume of the sacs becomes smaller and volume of the volatile compounds also decreases with the result that by the time the system reaches ambient temperature, it stabilizes and the volatile components remain in the coating. The reason that evolution of volatile components in such coating is minimized is because the heating is selective and is directed at specific portion(s) of the coating. Pursuant to the invention herein, only a portion of the coating is heated and not the entire coating as in prior art. Therefore, heating of only a portion of the coating thickness produces only a portion of volatile components and selection of a relatively non-porous coating matrix reduces evolution and/or production of volatile components and other hazardous waste and byproducts.

Aircraft and ship substrates typically employ fiberglass or carbon fibers with substrate matrix typically being epoxies or polyimides for aircraft and the more water-resistant polyester resins for ships. As long as temperature of about 50° C. is not exceeded within the substrate, no evolution and/or production takes place of volatile organic compounds or other hazardous waste and byproducts.

Having described the invention, the following examples are given as particular embodiments thereof and to demonstrate the practice and advantages thereof. It is understood that the examples are given by way of illustration and are not intended to limit the specification of the claims in any manner.

EXAMPLE 1

This example demonstrates the use of microwave energy to degrade a radar absorbing coating disposed on a metallic substrate. This coating was intended to absorb low frequency microwave radiation, i.e., approximately 1 G Hz, which is particularly useful on ship structures.

Samples were prepared by casting 6 mm thick layers of a two-part epoxy filled with 5% by volume of −325 mesh magnetic iron oxide (magnetite) powder to produce a radar absorbing material with a moderate dielectric constant of about 20 and a high dielectric loss of about 0.3. This material, in the form of sheets, was then bonded using a high strength epoxy adhesive to 1.6 mm thick 2024-T4 aluminum substrate. Thermocouples were placed on top of the coating material, at the interface between the aluminum substrate and the coating material, and at the midplane of the filled epoxy coating material. The samples were then heated with an 83 G Hz millimeter-wave beam at a power density of approximately 100 W/cm$^2$ while the outputs of the thermocouples were measured.

The results of this relatively low power experiment were that the midplane of the coating reached 300° C. in about 30 seconds at which point the aluminum-coating interface had reached about 60° C. and the top of the coating material was almost at ambient temperature of 25° C. When the experiment was terminated, the filled epoxy coating had been degraded and charred and had completely debonded from the aluminum substrate.

EXAMPLE 2

This example demonstrates decomposition of a radar absorbing coating composed of a urethane rubber filled with iron filler particles disposed on a substrate composed of an aluminum foil and a fiberglass reinforced polyester composite by means of high frequency microwave energy. These type of coatings are primarily used on aircraft and are intended to absorb high frequency microwaves of about 30–100 G Hz.

A commercially prepared radar absorbing coating layer composed about 5% by volume iron silicide filler in a urethane rubber about 1 mm thick, was bonded to a fiberglass reinforced polyester composite substrate about 5 mm thick using a high strength two-part epoxy adhesive and an intermediate 12 micron thick aluminum foil ground plane between the urethane coating and the composite. The composite and the aluminum foil comprised the substrate. Thermocouples were placed on the front surface of the coating, between coating and the aluminum foil bonded to the composite, and at a location approximately 1 mm away from the interface within the composite.

This sample was subjected to irradiation by the 83 G Hz millimeter-wave beam energy for about 2 seconds at a power density of about 350 W/cm$^2$ to deposit about 700 J/cm$^2$ of energy. With this amount of energy deposition, the front surface of the coating reached 250° C. in about 3 seconds and the interface between the coating and the aluminum foil ground plane reached 95° C., also in about 3 seconds, following which, the temperatures declined back to near ambient over 30–40 seconds. The temperature in the composite 1 mm down from the groundplane rose gradually to a maximum of about 55° C. after about 40 seconds and then decayed back to ambient.

The coating, where irradiated by the beam, bubbled up with the interior of the coating charred and powdered. The remnants of the coating could be readily be removed from the substrate with plastic scrapers without damaging the aluminum foil.

The advantages realized by this process are enormous compared to prior art. This process heats high dielectric constant and high dielectric loss coatings in a manner which is most conducive to their removal without thermal or mechanical damage to the substrate to which the coatings are bonded. This process works by in-depth heating which is characteristic of microwaves, and millimeter-waves in particular. The process also benefits from standing wave effects that are associated with the much shorter wavelength of millimeter-waves in such coating materials and can be optimized for particular classes of coating materials relating to their dielectric properties and thickness, through the use of different frequencies of millimeter-waves, sources of which are available commercially from 28 to 94 GHz. Nature of the heating process ensures that most of the byproducts of heating the coating are contained within the thickness of the coating and that it is not necessary to heat the coating to extremely high temperature, thus minimizing emission of volatile organic compounds and other hazardous wastes. The process uses a robust industrial millimeter-wave source with high continuous power with high efficiency of about 50% at maximum power and with output in a collimated beam with Gaussian profile. The beam nature of the source permits effective control of local energy deposition in a coating on a structure of complex shape and large size. Process modeling permits effective process control through measurement of coating surface temperatures.

While presently preferred embodiments have been shown of the novel process for removal of radar absorbing coating disposed on a substrate, persons skilled in this art will readily appreciate that various additional changes and modifications can be made without departing from the spirit of the invention, as defined and differentiated by the following claims.

What is claimed is:

1. A process for removing a microwave-absorbing coating disposed on a substrate and having an interface between the coating and the substrate, the process comprising the steps of irradiating the coating with sufficient amount of microwave energy to damage the coating and removing the coating from the substrate without substantially heating the substrate.

2. The process of claim 1 wherein the microwave energy is in the range of about $5\times10^{-23}$ to $5\times10^{-21}$ joules and the microwaves have wavelength of 1 to 100 mm.

3. The process of claim 2 wherein the microwave energy has power range in the range of about 50 to 500 W/cm$^2$ and energy density in the range of about 100 to 1000 J/cm$^2$.

4. The process of claim 3 wherein the coating is millimeters to centimeters in thickness and it comprises an elastomer matrix and contains up to about 10% by volume of a particulate filler selected from the group consisting of metallic particles, ceramic particles, and mixtures thereof.

5. The process of claim 1 wherein the substrate is selected from the group consisting of metallic plates and fiber-reinforced polymers having a metallic layer on the side of the fiber-reinforced polymer which faces the coating.

6. The process of claim 4 wherein the substrate is selected from the group consisting of metallic plates and fiber-reinforced polymers having a metallic layer on the side of the fiber-reinforced polymer which faces the coating.

7. The process of claim 6 wherein the microwave energy has frequency in the range of about 25 to 100 G Hz, the process including the step of adhering the coating to the substrate by means of an adhesive, thus forming an adhesive bond between the coating and the substrate.

8. The process of claim 7 including the step of moving the microwave energy over the coating by the use of optics.

9. The process of claim 7 including the step of rastering the microwave energy at a rate of 10–100 cm$^2$/sec over the coating in order to deposit energy on the order of 700 J/cm$^2$ to facilitate removal of the coating from the substrate.

10. The process of claim 7 including the step of heating the coating at a location within the coating in the vicinity of the interface of the coating and the substrate.

11. The process of claim 7 wherein said irradiating step is conducted for the period of from instantaneous to several seconds.

12. The process of claim 11 wherein temperature within the coating is higher than temperature on its surface and temperature within the substrate is below the coating surface, within 40 seconds after the microwave energy is turned off.

13. The process of claim 12 wherein dielectric constant of the coating is 10–100 and its dielectric loss is 0.1–1.

14. A process for removing radar absorbing coating having dielectric constant of 10–100 and dielectric loss of 0.1–1 from a substrate, the process intended to minimize thermal and mechanical damage of the substrate and to minimize production of volatile coating components and hazardous waste and byproducts, the process comprising the steps of directing sufficient microwave energy of into the coating to damage it and removing the damaged coating.

15. The process of claim 14 wherein the microwave energy is in the range of about $5\times10^{-23}$ to $5\times10^{-21}$ joules, the microwaves have wavelength of 1 to 100 mm, the microwave energy has power range in the range of about 50 to 500 W/cm$^2$, and the microwave energy density is in the range of about 100 to 1000 J/cm$^2$.

16. The process of claim 15 wherein the coating is millimeters to centimeters in thickness, wherein the coating is an elastomer and contains up to about 10% by volume of a particulate filler selected from the group consisting of metallic particles, ceramic particles, and mixtures thereof, wherein the substrate is selected from the group consisting of metallic plates and fiber-reinforced polymers having a metallic layer on the side of the fiber-reinforced polymer which faces the coating.

17. The process of claim 16 wherein the microwave energy has frequency in the range of about 25 to 100 G Hz, the process including the step of adhering the coating to the substrate by means of an adhesive thus forming an adhesive bond between the coating and the substrate.

18. The process of claim 17 including the step of moving the microwave energy over the coating by the use of optics.

19. The process of claim 17 including the step of rastering the microwave energy at a rate of 10–100 cm$^2$/sec over the coating in order to deposit on the order of 700 J/cm$^2$ energy to facilitate removal of the coating from the substrate.

20. The process of claim 17 including the step of heating the coating at a location within the coating in the vicinity of the interface of the coating and the substrate.

* * * * *